US007431680B1

(12) United States Patent
Hinds et al.

(10) Patent No.: US 7,431,680 B1
(45) Date of Patent: Oct. 7, 2008

(54) RECIPROCATION-PULL STATIC LINE EXERCISING ASSEMBLY

(76) Inventors: Robert Sylvester Hinds, 137 E. Wilson St., Condo 1411 East, Madison, WI (US) 53703; Loyd William Bonneville, 1213 Amsterdam Ave., Madison, WI (US) 53716

( * ) Notice: Subject to any disclaimer, the term of this patent is extended or adjusted under 35 U.S.C. 154(b) by 25 days.

(21) Appl. No.: 11/690,107

(22) Filed: Mar. 22, 2007

Related U.S. Application Data

(63) Continuation-in-part of application No. 11/479,777, filed on Jun. 30, 2006, now Pat. No. 7,316,636, and a continuation-in-part of application No. 11/544,357, filed on Oct. 6, 2006.

(51) Int. Cl.
*A63B 23/16* (2006.01)

(52) U.S. Cl. ..... 482/49; 482/44

(58) Field of Classification Search ..... 482/44–49, 482/121–126, 904, 907, 39–41, 74; 446/266
See application file for complete search history.

(56) References Cited

U.S. PATENT DOCUMENTS 232,529 A 9/1880 Weeks
3,873,088 A * 3/1975 Panepinto ..... 482/126
5,894,631 A * 4/1999 Chiu ..... 16/110.1
5,957,813 A * 9/1999 Macdonald ..... 482/44
6,267,711 B1 7/2001 Hinds
6,398,698 B1 * 6/2002 Hinds ..... 482/126
6,663,544 B2 * 12/2003 Hinds ..... 482/126
6,988,978 B1 * 1/2006 Nault et al. ..... 482/126
7,147,592 B2 * 12/2006 Hinds et al. ..... 482/126
7,316,636 B1 * 1/2008 Hinds et al. ..... 482/126
2002/0052270 A1 * 5/2002 Hinds ..... 482/126
2005/0075223 A1 * 4/2005 Wu ..... 482/126
2005/0255976 A1 * 11/2005 Hinds et al. ..... 482/126
2006/0052223 A1 * 3/2006 Terry ..... 482/126
2006/0105893 A1 * 5/2006 Chen ..... 482/126

* cited by examiner

*Primary Examiner*—Fenn C Matthew
(74) *Attorney, Agent, or Firm*—Loyd W. Bonneville

(57) ABSTRACT

The operator exercises by gripping a palm bar in each hand. Each end of a static or non-stretchable line or cord is run through a tunnel within a respective palm bar and secured therein, usually with a knot. A pivoting impinger is installed within the palm bar so that its head swings into the bottom of the tunnel against the static line to keep it from slipping out of place. Each end of a different cord, a stretchable one, is anchored within the ends of the palm bar with its mid-portion, usually padded, arranged to snugly encircle the back of the operator's respective hand for support. The mid-portion of the static line runs through a pulley system which has an impingement strap connected to it for anchoring to a wall or door in any one of several ways.

16 Claims, 7 Drawing Sheets

244
242 241 243
21 22 23 24
2
14
141
151
15
111
1161
1141 116
114
115
112
113
11
1
500
3
31
310
1183 1182
1181
118
156
155

RECIPROCATION-PULL STATIC LINE EXERCISING ASSEMBLY

CROSS-REFERENCE TO RELATED APPLICATIONS

This instrument, filed under 37 CFR 1.53(b) and 1.78 invoking the provisions of 35 U.S.C. 120, is a Continuation in Part of application Ser. Nos. 11/479,777 entitled "Impinged Retention Exercise Assembly", filed Jun. 30, 2006 now U.S. Pat. No. 7,316,636 and 11/544,357 entitled "Retained Impinger for Universal Sports Use", filed Oct. 6, 2006.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

Exercise Equipment

2. Description of Related Art

Occasionally a descriptive term in this application may be shortened so as to recite only a part rather than the entirety thereof as a matter of convenience or to avoid needless redundancy. In instances in which that is done, applicant intends that the same meaning be afforded each manner of expression. Thus, the term pulley wheel assembly tethering means (24) might be used in one instance but in another, if meaning is otherwise clear from context, expression might be shortened to assembly tethering means (24) or merely tethering means (24) Any of those forms is intended to convey the same meaning.

The term attach or fasten or any of their forms when so used means that the juncture is of a more or less permanent nature, such as might be accomplished by nails, screws, welds or adhesives. Thus it is stated herein that the connection of the strap anchoring hook (249) to a wall (600) or door (700) is one of attachable mounting. A connection in which an object is easily removed from another is described by the word emplace, as where it is stated herein that the door impingement strap loop (242) is emplaced upon either a hook (249) or a portion of an over-the-door bracket (248) for connection. A connection in which two objects, although not attached could be separated only with considerable difficulty is referred to herein as one of rigid emplacement. The snapping in place of the stretchable hand wrapping media member (15) into the hand bar's media member accommodation means (114) is stated herein to provide such a connection. Employment of the words connector join or any of their forms is intended to include the meaning of any of those terms in a more general way.

The word comprise may be construed in any one of three ways herein. A term used to describe a given object is said to comprise it, thereby characterizing it with what could be considered two-way equivalency in meaning for the term.

Thus, it is stated that the impinger's stem (1183) comprises a more or less slender rod-like member-one of three parts of the impinger (118), meaning that the latter is in fact the former and the former, the latter. The term comprise may also be characterized by what might be considered one-way equivalency, as when it is stated herein that in one of two variants of the subject matter hereof, a media member well (1143) comprises the media member accommodation means (114), meaning that the well (1143) is itself the media member accommodation means (114). This use of the word has a generic sense to it. That is, a well (1143) will always be media member accommodation means (114) but media member accommodation means (114) may be a well (1143) in one case but something else—a tunnel (1141), for instance—in another. However, the word comprise may also be used to describe a feature which is part of the structure or composition of a given object. Thus, the palm bar (11) is said to comprise, among other things, a static line tunnel (113) as a component thereof (11). The meaning in the respective cases is clear from context, however. Accordingly, modifying words to clarify which of the three uses is the intended one seem unnecessary.

Terms relating to physical orientation such as top or bottom, upper or lower, upwards or downwards, refer to the positioning of an object in the manner in which it would be typically oriented for use or viewing. The palm bar's top (111) is, thus, the surface directly in contact with the palm of the operator's (500) hand while its bottom (112) is the opposing portion thereof oriented downward from the open aspect of the hand. Similarly, the over-the-door bracket is seated upon the door's (700) upper edge. One end of a stretchable hand wrapping media member (15) is said to ascend from one of the bar's media member accommodation means (114), extend upward in looped configuration permitting it (15) to extend across the back of an operator's (500) hand then descend for downward insertion into opposing media member accommodation means (114). And the combination's static line is described as extending upward between the operator's (500) middle and ring fingers. It is intended that orientational references to the object be equally understood regardless of any theoretical disposition of it such as, for example, if it were held upside down.

The phrase in communication with indicates an openness between a first cavity, chamber or other opening with a second, suggesting unbarred or unimpeded egress and ingress from one to the other as, for example, that described with reference to a media member access slot (116) and a respective media member accommodation means (114)—whether tunnel (1141) or well (1143). The relational phrase disposed in opposition or equivalents thereof such as opposing and oppositely, indicate dual existence and locus, such as that of the media member access slots (166), the first of which is disposed at a palm bar's (11) first end and the second, at the other.

Moreover, certain other words may occasionally be coined herein to simplify discussion by interchanging noun, verb or adjective or by modifying certain words. It takes little imagination to understand, for example, that the coined word impinger (118) has been recognized as identifying an object which is capable of impingement upon another object. The word rotable is another example of coining use denoting the behavior of turning upon an axis rather than some sort of spinning motion which might be addressed by the more cumbersome word rotatable. The expression attachably is coined for convenience, in one instance at least, from the root of attach. The word tunnel is used both as a verb and noun herein, the former referring to the process of excavation required to create the object addressed by the latter—say, the line tunnel (113), for instance; or, perhaps, to a first object's passage through a second—as, for example, that of the line tunnel (113) through the palm bar (11). In a related sense, the line (3) is said in keeping with common parlance to run from one point to another, indicating, of course its (3) directional progression or extension along that path, rather than any particular movement thereof (3), whatever capabilities for such movement there might or might not be. The verb expression enreeve is borrowed from the state of existence term enreevement and considered herein to derive from the root word reeve—the extension of a first member through an aperture or longitudinal passageway in a second.

The word static as used in conjunction with line herein—the cord-like tethered extension (3) of the exercise assembly—is merely the positively stated equivalent herein of the less preferred and, perhaps, more cumbersome negative expression non-stretchable.

Several features of the subject matter hereof exist in pairs or comprise paired members of the assembly. In instances in which expression concerning such a paired feature or member is given in the singular, it should be interpreted to apply as to the paired aspect thereof.

The adjective reciprocation-pull frequently used herein, denotes exercise in which in operator (500), either gripping tethered paired members of an exercise assembly—one in each hand—or having them paired in connection to the body in some manner—right ankle and left ankle, for example—pulls backward upon one member of the pair and then the other in an alternating manner so that advancement and withdrawal of the members occurs in a reciprocating manner. That undertaking in exercise is, of course, an ancient one.

Experience has, thus, already taught a great deal with reference to the practice of using stretchable members in an exercise assembly. In a hollow cord, for example, it is a common practice to insert a plug or stopper (156) for what is herein regarded as stop means (155). It is also known that the stretchable member may be thinned out by pulling upon it to stretch it out for emplacement within a slot formed to receive it and snapping it into place. The use of a door impingement strap (241), wherein a thickened sector (243) is disposed on the side of the door (700) opposite that from which exercise tension is derived, has also been widely adopted as anchoring means for an exercise pulling assembly. The thickened sector (243) often acts either—or sometimes as both—by its (243) impingement between the door (700) and its frame (701) and as a blocker which cannot be pulled through the space. Then, too, the co-engagement of such a cord with various sorts of pulley systems has been relied upon for a very long time. An easy-to-hook-up pulley comprising a pulley wheel connecting frame (23)—or block, as it is sometimes referred to—with housing and axle (22) connection along but one side of the pulley wheel (21) was illustrated, for instance, in U.S. Pat. No. 6,267,711 issued to Hinds.

The benefits in employing one or more non-stretchable or static lines (3) in a reciprocation-pull exercise assembly have been with us not just for decades but, perhaps, centuries. In 1880, U.S. Pat. No. 232,579 issued to Weeks provided a static line as the main one of an interconnected tethered linkage, also including stretchable cords, running through a series of pulley wheel assemblies (2) and terminating in handgrips held by an operator (500); and the solely static tethered cord (3) was undoubtedly extant long before that in conjunction with weights and pulleys.

The securing of stretchable cords within handgrips with an impinger eventually became popular. The attempt to impinge non-stretchable, or static, cords was fraught with difficulty, however, in that the cord often tended to work free from its retention during repetitious and vigorous use. For some time, impingers were components separate from the handhold they were intended to serve. They occasionally loosened their grip or became misplaced or lost. Ultimately, a dependable impinger anchored within the exercise handhold was provided in U.S. Pat. No. 7,147,592 issued to Hinds, et al. Experience now has demonstrated that system's applicability even to a static cord (3).

It seems reciprocation-pull rehabilitative exercise benefits more from static cord tethered (3) arrangements than from the stretchable sort. Many now also consider zero resistance to the pulling effort superior in rehabilitation programs than tugging against resistance or weights. Under this view, the repetition has become more important than the foot-pounds of muscular energy expended.

While the prior art has provided an enormous number of exercise assemblies—many of them reciprocation-pull arrangements—one cannot help but recognize the need for one which is dependably secured, yet simple in essence.

BRIEF SUMMARY OF THE INVENTION

The invention comprises in the main a reciprocation-pull static line exercising assembly wherein paired handgrip assemblies (1), one for each of the operator's (500) hands, are connected to a pulley wheel assembly (2) tethered to a wall (600) or door (700). The non-stretchability of the line (3) offers control and dependability greater in rehabilitative undertakings than that experienced with the less preferred stretchable tether. Each member of the handgrip assembly (1) comprises a hand-wrapping member which is stretchable (15), however, to assist the operator's (500) grip. To comfort its (15) embrace upon the back of the hand, a flexible back-of-the-hand restraining pad (14) comprising a pad tunnel (141), through which the member (15) is enreeved, is preferred.

To obviate the usual static line (3) problem of handgrip slippage, the palm bar (11), a member of the handgrip assembly (1), comprises at the bar's bottom (112), an impinger (118) hinged in a manner which directs its head (1182) into a static line tunnel (113) within the bar (11), causing it (1182) to bear tightly against the line (3) for retention therein.

Because it is conceivable the palm bar (11) could be employed as a novel ingredient of other yet-to-be-conceived exercise assemblies, it (11) is also featured herein in its own right.

BRIEF DESCRIPTION OF THE SEVERAL VIEWS OF THE DRAWINGS

Solid lines in the drawings represent the invention. Dashed lines represent either non-inventive material, that not incorporated into an inventive combination hereof and which may be the subject of another invention, or that which although so incorporated, lies beyond the focus of attention. A heavily framed outline of a portion of the drawing is representative of a number of specific variations of the more generic feature it identifies.

DETAILED DESCRIPTION OF THE INVENTION

Figure 1:
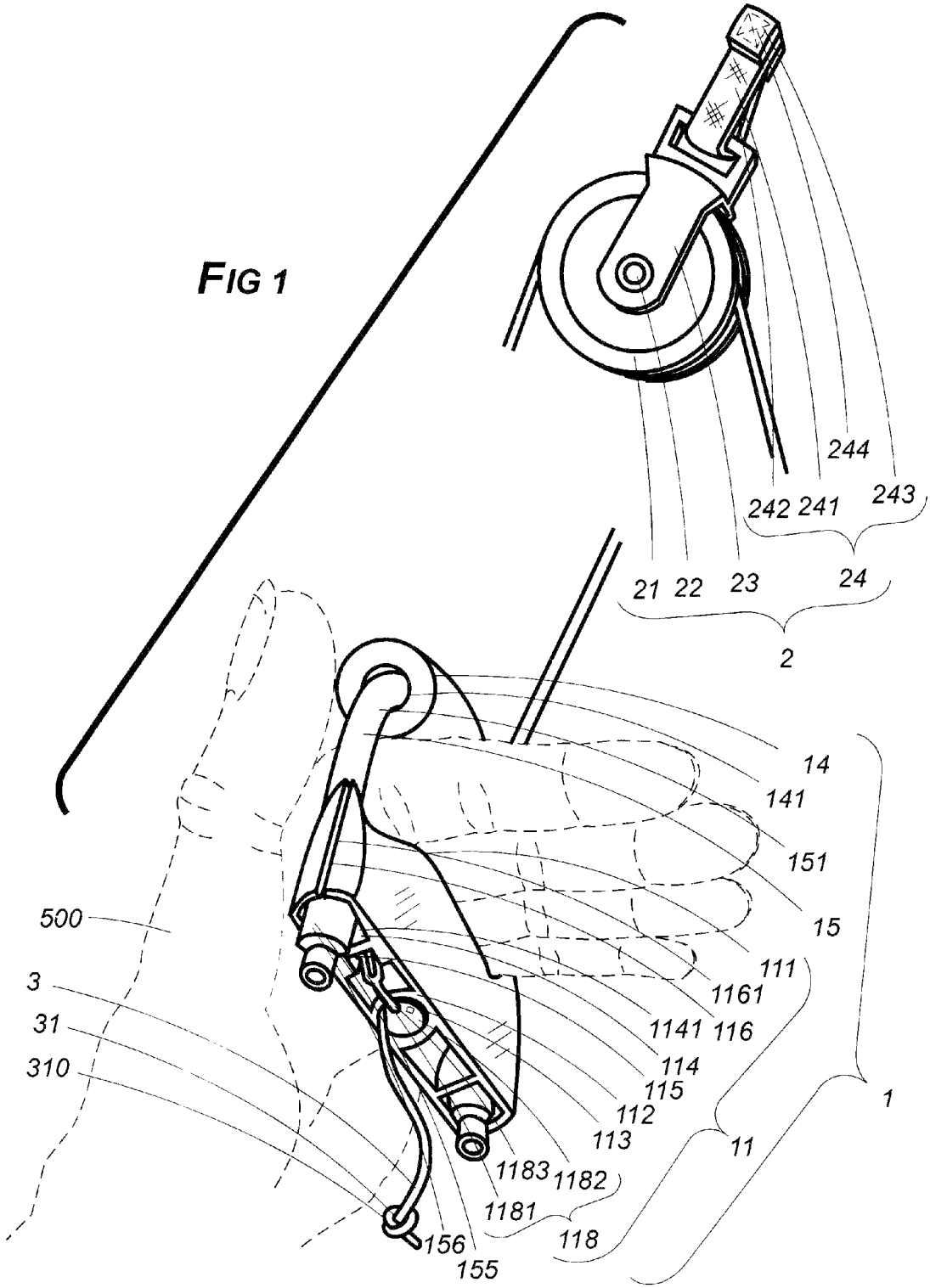
FIG. 1 depicts a perspective view of a graphical conjunction of otherwise separated components of a preferred version of the entire assembly. A door impingement strap (241) is included for possible pinch-tethered impingement with hollow stretchable cord (151) comprising the stretchable hand wrapping media member (15).
Figure 2:
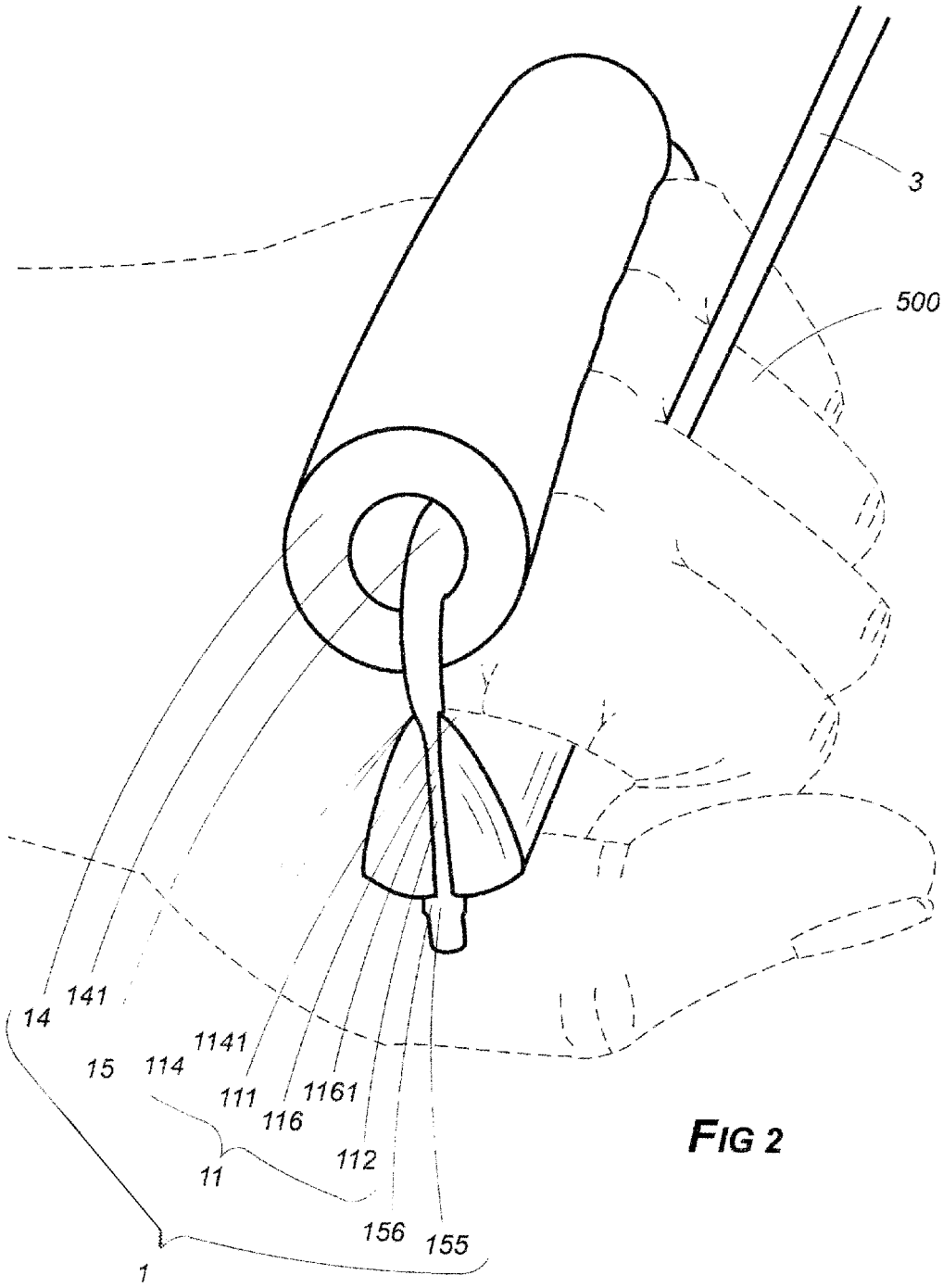
FIG. 2 illustrates in perspective an operator's grip upon of the palm bar (11) wherein a flexible back-of-the-hand restraining pad (14) provides a cushioning support.
Figure 3:
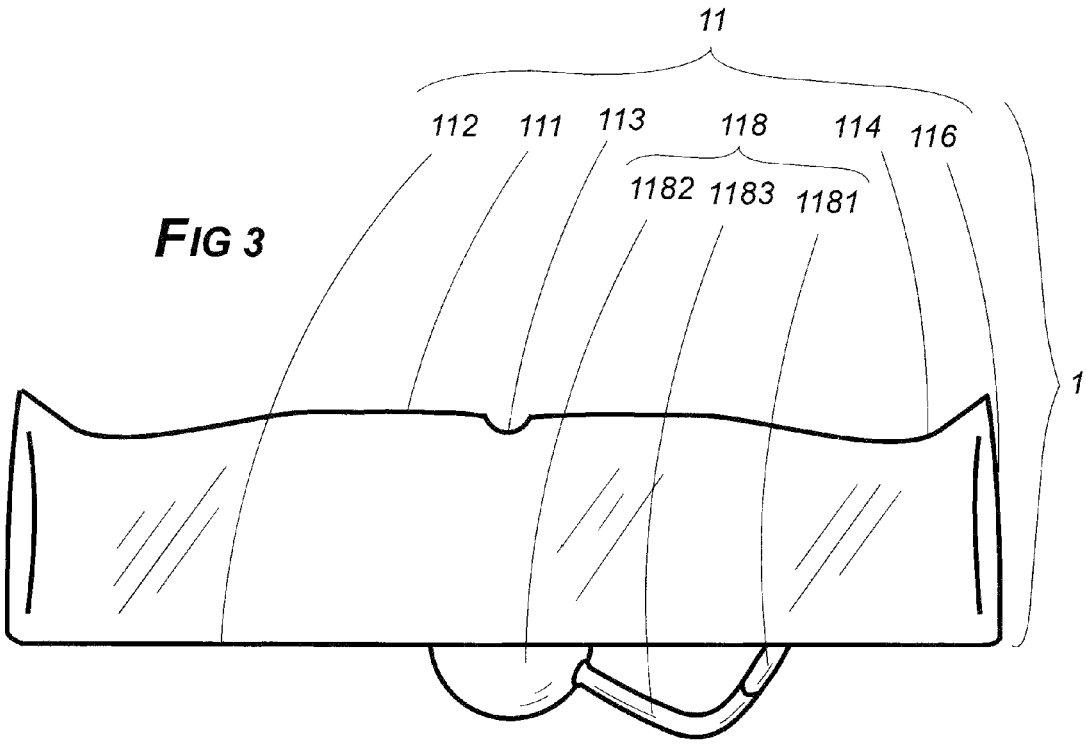
FIGS. 3 and 4 represent the palm bar (11) in respective side and bottom (112) views.
Figure 4:
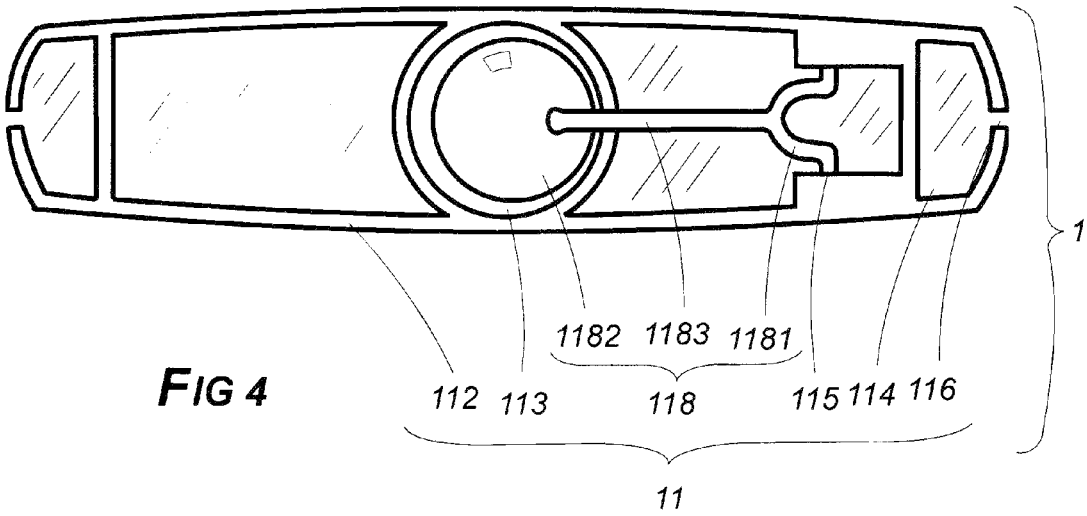
Figure 5:
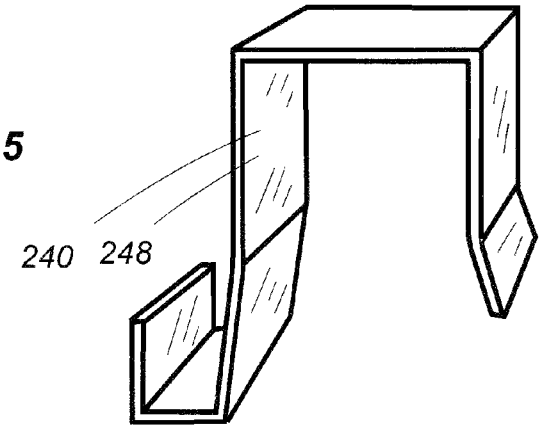
FIGS. 5 and 6 comprise members of the pulley wheel assembly (2) as well as an over-the-door bracketed (248) version of its tethering means (24).
Figure 6:
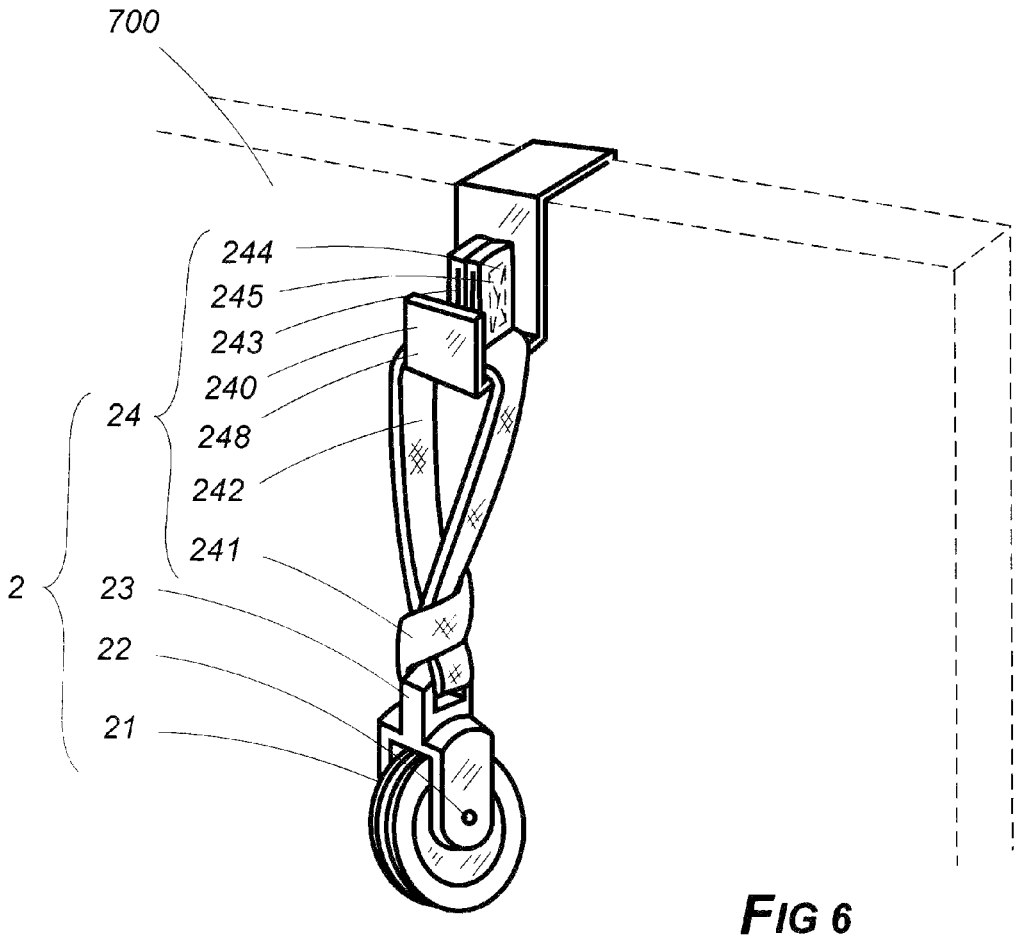
Figure 7:
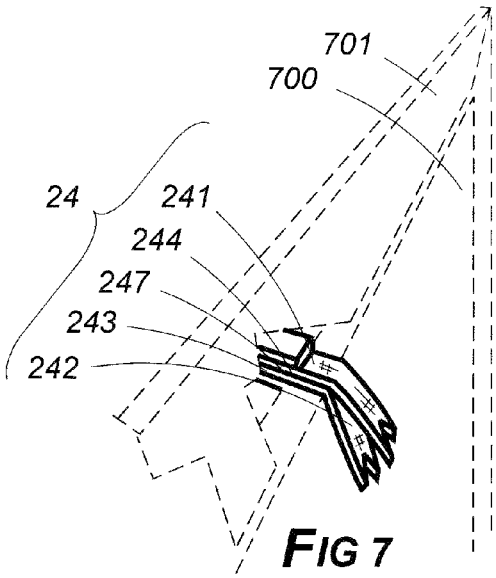
FIGS. 7 and 8 illustrate alternative tethering means (24), the former, pinch-tethering by reason of a door impingement strap (241), the latter, pending suspension upon a hook (249).
Figure 8:
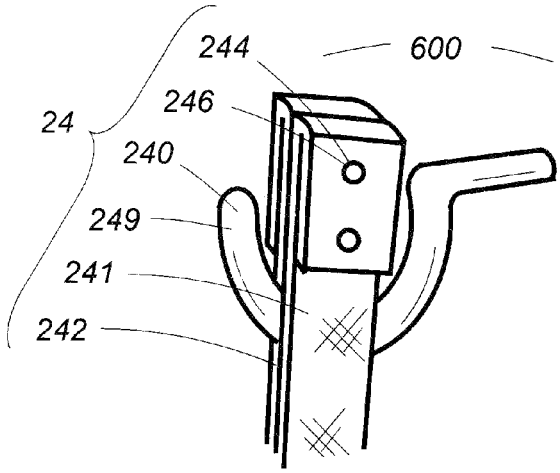
Figure 9:
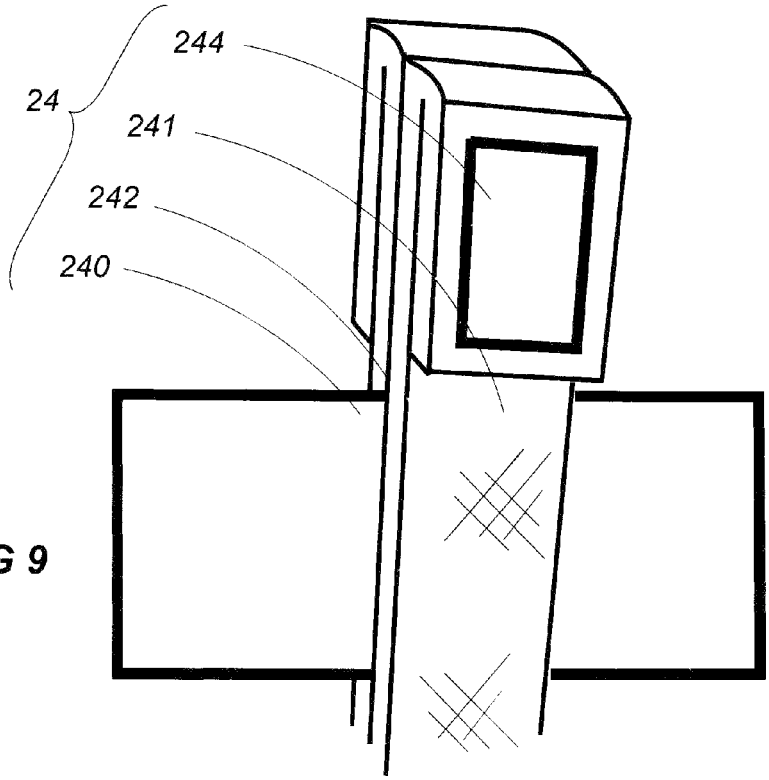
FIG. 9 comprises generic representations of the pulley wheel tethering means (24) with both the strap anchoring means (240) and the strap terminal fastening means (244) so shown.
Figure 10:
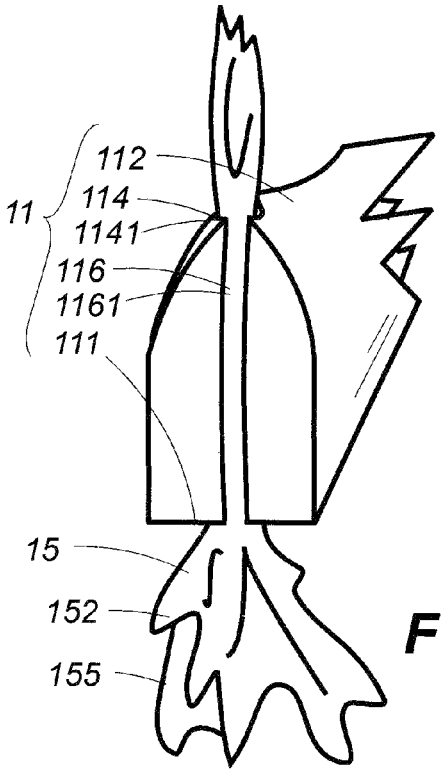
FIGS. 10-12 comprise perspective views of three kinds of stretchable hand wrapping media members (15) and their stop means (155); respectively, stretchable sheeting (152), stretchable strapping and solid stretchable cord (154).
Figure 11:
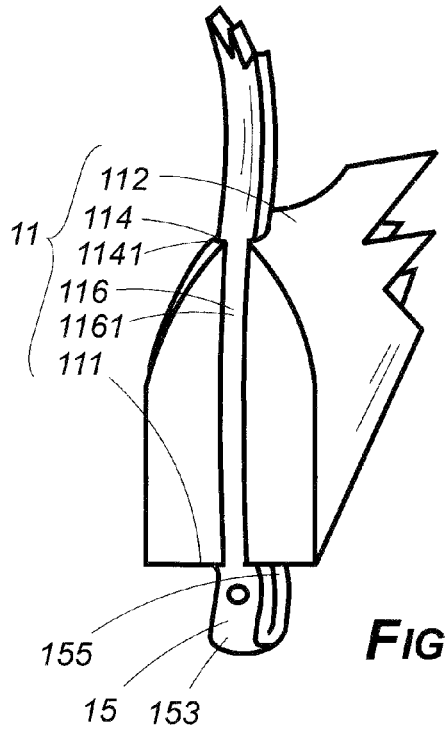
Figure 12:
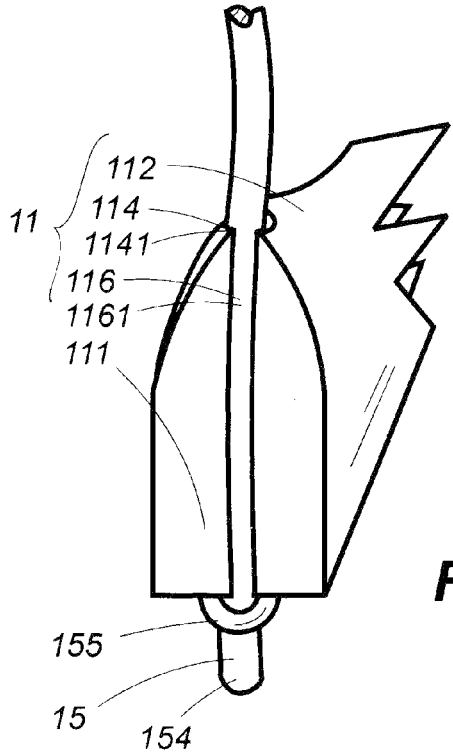
Figure 13:
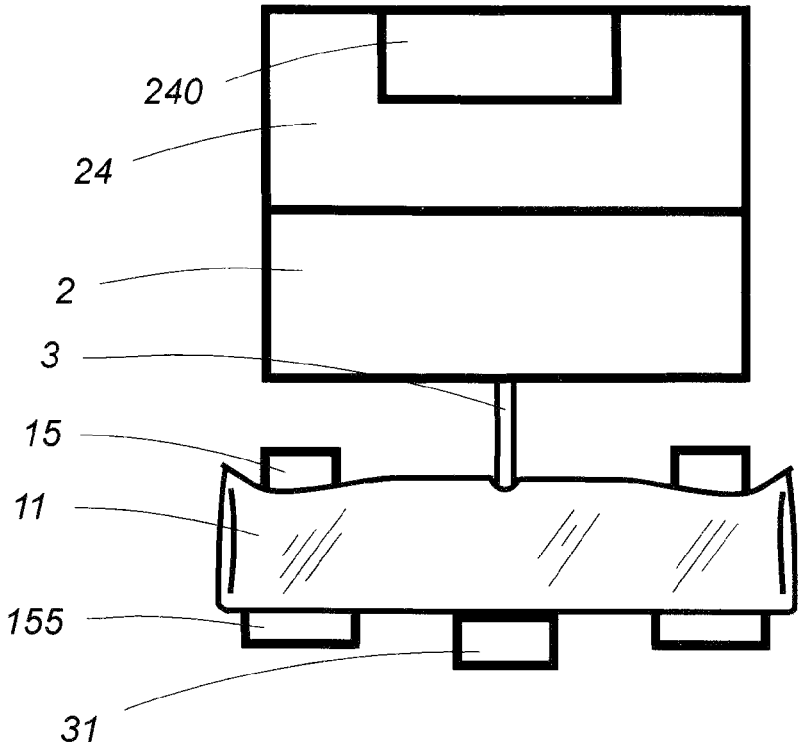
FIG. 13 comprises a group of additional generic presentations for the pulley wheel assembly (2); its tethering means (24) and its strap anchoring means (240); the stretchable hand wrapping media member (15) and its stop means (155); and the static cord's terminal stop means (31).
Figure 14:
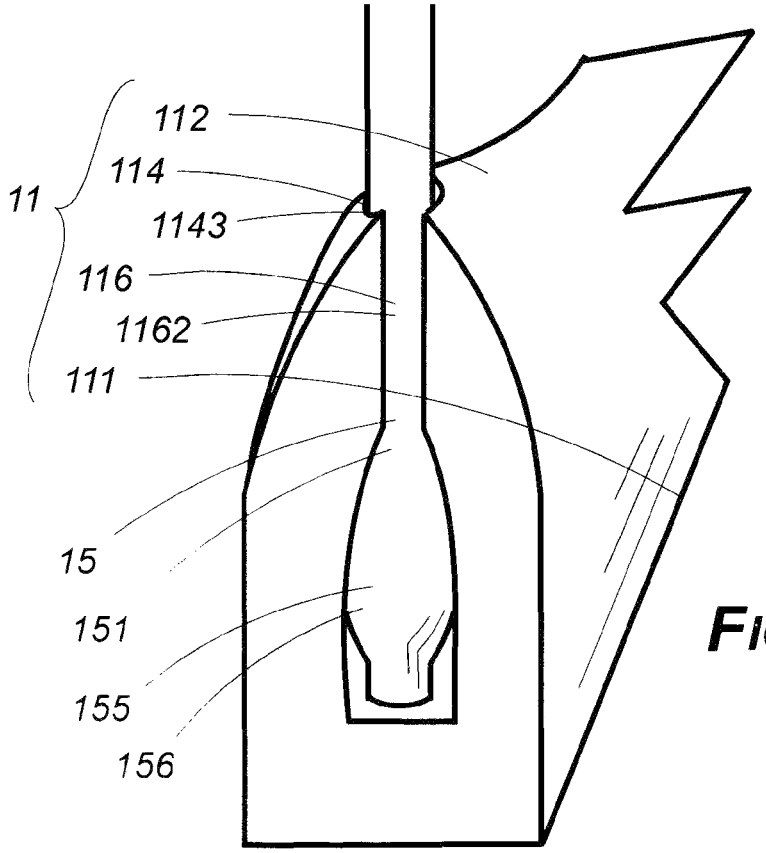
FIG. 14 illustrates in perspective a stretchable hand wrapping media member (15) and its stop means (155); respectively comprising, hollow stretchable cord (151) with an embedded stopper disposed within an media member well (1143) which tunnels only part way through the palm bar (11) rather than through the entirety thereof (11).

The subject of this application is first, a combination comprising an exercise assembly and second, a singular member thereof solely. The combination comprises a handgrip assembly (1) disposed to allow a non-stretchable cord—or static line (3) also comprised by the assembly, to pass through fingers of the operator (500) to a pulley wheel assembly (2) so that the line (3) is withdrawn and advanced in reciprocation-pull fashion in undertaking the exercise. To prevent slippage of the static line (3) otherwise likely to occur, the palm bar (11)—a hand-held member of the handgrip assembly (1)—comprises at its bottom (112) an impinger (118) which, by reason of its particular construction, dependably retains the static line (3) within the bar (11) at whatever distance from the pulley wheel assembly (2) the leads of the line (3) are adjusted for.

It is the palm bar (11), itself, which comprises the singular member, as referred to supra, of the entire assembly as distinct inventive material hereof.

The handgrip assembly (1) comprises the paired palm bars (11) mentioned supra and for each (11), one of a variety of stretchable hand wrapping media members (15)—so called because of the manner it (15) encircles and supports the back of the operator's (500) respective hand. The ends of the media member (15) connect in opposition to each of the bar's (11) ends. Each palm bar comprises accommodation means (114)—a tunnel (1141) or a well (1143)—in turn comprising an opening at the palm bar's top (111) into which the media member (15) is inserted.

One end of each thereof (15) is disposed to ascend from one of the bar's media member accommodation means (114)—either a tunnel (1141) or a well (1143), ante—extend upward in looped configuration permitting it (15) to traverse and embrace the back of an operator's (500) hand then descend for downward insertion into the bar's other—the opposing—media member accommodation means (114). A reasonably snug fit of the member (15) enhances security for the operator's (500) grip. Preferably, to cushion the back of the operator's (500) hand, the assembly (1) also comprises a tubularly configured flexible back-of-the-hand restraining pad (14) the media member (15) is disposed to enreeve, or pass through.

In a first considered assembly, the accommodation means (114) comprises a tunnel (1141) disposed to pass from the palm bar's top (111) to its bottom (112) and the media member (15) is emplaced by enreevement downwardly through its (1141) entirety. The member (15) comprises stop means (155) which, following enreevement, reposes at the palm bar's bottom (112).

In a second considered assembly, a well (1143) comprises the media member accommodation means (114), the well (1143) disposed to pass only part of the distance from the palm bar's top (111) toward its bottom (112) and the media member (15), rather than enreeving a tunnel (1141) is merely emplaced to extend downwardly into the well (1143). The member (15) comprises stop means (155) which, following its (15) emplacement within the well (1143), is also disposed therein.

In either considered assembly, the stop means (155) is of size sufficient to prevent being pulled out of its respective accommodation means (114) during exercise.

Each palm bar (11) further comprises paired access slots (116), one disposed at each of the palm bars' (11) ends in communication with the respective media member accommodation means (114) and configured with sufficient width to permit the hand wrapping media member (15), when thinned out by stretching for the purpose, to be snapped into place within the respective media member accommodation means (114). The connection is a dependable one qualifying as what is herein regarded as one of rigid emplacement. In the first considered assembly, like the tunnels (1141) the palm bar (11) comprises, each bar's media member access slot (116) is configured also to extend from the bar's top (111) to its bottom (112) and is accordingly labeled a full length access slot (1161). In the second considered assembly, the access slots (116) extend downward also in communication with the media member accommodation means (114), but in this instance, as with the wells (1143) the palm bar (11) comprises, downward extension of each access slot (116) is but part the distance between the palm bar's top (111) and its bottom (112) and is accordingly designated a partial length access slot (1162).

The palm bar (11) also comprises a static line tunnel (113) passing from its top (111) to its bottom (112). Preferably, the line tunnel (113) is centrally disposed so that during exercise, the static line (3) enreeved through it (113) extends upward between the operator's (500) middle and ring fingers.

The static line impinger (118) comprised by each palm bar (11) is disposed at its bottom (112) as a part thereof (11), preferably at least partly within it (11). It (118) comprises a rotable anchor (1181), a head (1182) and a stem (1183).

The impinger's head (1182) may be configured in any one of a number of ways. While any of several prior art shapes comprising a circular cross-section will work satisfactorily, the spherical is preferred.

The impinger's stem (1183) comprises a more or less slender rod-like member attached to the head (1182) at one end and the rotable anchor (1181) at the other. It (1183) is preferably configured as a curved extension comprising composition and thickness affording it (1183) a relatively rigid character.

The rotable anchor (1181) of the impinger (118) is disposed at one end of the stem (1183), the head (1182), at the other. The anchor (1181) preferably comprises a pinchable characteristic of U-shaped configuration as a bifurcated stalk, joining the stem (1183) at the mid-portion of the bend or U-more or less like the outer tines of a pitchfork join its handle. Opposing portions of the rotable anchor (1181) extend laterally to provide an axillary configuration which, when retained, require the impinger's stem (1183) and head (1182) to sweep through a predetermined arc in a plane perpendicular to the anchor's (1181) lateral axle-like extensions. The disposition and configuration of the impinger (118) are such as to require its head (1182) to enter the static line tunnel (1183) at the palm bar's bottom (112) and impinge against a static line (3) enreeved therein (113). Impingement is enhanced by the reciprocation-pull forces upon the line (3) during exercise, drawing the impinger's head (1182) more tightly against itself (3). The rotable anchor is configured in a manner such that when retained, remains free to pivot along an axis, causing the stem (1183) and head (1182) to sweep through a predetermined arc in a plane disposed perpendicular to the pivoting axis;

The palm bar (11) must additionally accommodate the impinger's (118) rotable function. To this end, it (11) comprises static line impinger axillary retention means (115) wherein the static line impinger's rotable anchor (1181) is retained in a manner permitting it (1181) to pivot such that the impinger's head (1182) is caused to enter the static line tunnel (113) from the bottom (112) of the respective palm bar (11) and is disposed in an attitude to impinge against and secure the enreeved static line (3). The palm bar's axillary retention means (115) need be nothing more than a socket or other opening within which the impinger's anchor (1181) may be disposed for rotability.

If for the purpose of aesthetic streamlining, the palm bar's media member wells (1143) terminate within the palm bar (11) as optionally suggested supra, the media member access opening (116) must comprise a sector of enlargement—that is, a well's chambered opening (1163)—sufficient to permit the media member's stop means (155) to be pressed into the respective well (1143). Thus, if the media member (15) comprised a stretchable hollow cord (151) in turn comprising an embedded stopper (156), a portion of the opening (1163) would comprise width sufficient to admit passage of the media member (15) and the stoppered portion (156) of the cord (151).

The static line (3) preferably comprises terminal stop means (31) disposed, as the name suggests, proximate the end of the line (3) reeved through the tunnel (113). The stop means (31) should comprise size sufficient to prevent being pulled through during exercise. A simple tied knot (310) is preferred.

The stretchable hand wrapping media member (15) may comprise stretchable sheeting (152), stretchable strapping (153) or stretchable cord either of solid (154) or the more preferred hollow (151) variety.

Experience demonstrates that stretchable sheeting (152) may be considered to inherently comprise its own stop means (155) by reason of the friction its (152) bulk and composition offers to its emplacement within the media member accommodation means (114). Stretchable hollow cord (151) is by far more commonly employed and its (152) tube-like configuration makes feasible the insertion of an embedded stopper (156) within its (152) end. Stretchable strapping (153) and stretchable solid cord (154) provide no such convenience and, therefore, would likely require tying or cinching off with a cleat, ring or other piece of hardware.

The assembly which is the subject matter hereof further comprises a pulley wheel assembly (2), in turn comprising a pulley wheel (21), a pulley wheel axle (22), a pulley wheel connecting frame (23) and pulley wheel assembly tethering means (24). Any one of several pulley assemblies available from the prior art may be incorporated into the system. In the known manner, the pulley wheel (21) turns freely upon the pulley wheel axle (22) disposed rotably within the pulley wheel connecting frame (23).

The static line (3) runs from a palm bar (11) gripped in one of the operator's (500) hands, is disposed to circumscribe or partially encircle the pulley wheel (21) and then return in extension to a palm bar (11) gripped in the operator's (500) other hand.

Any one of a number of known pulley wheel tethering means (24) may likewise be employed in the arrangement. The widely recognized door impingement strap (241) connected to the pulley frame (23) and comprising a strap thickened sector (243) may be included for emplacement between a door (700) and door frame (701). The door impingement strap (241) may comprise an impingement strap loop (242) for convenient tethered anchoring. Preferably, a strap (241) so configured is emplaced for connection upon either a hook (249) mounted by attachment to the wall (600) or door (700) or a portion of an over-the-door bracket (248) which, as the term suggests, is seated upon the door's (700) upper edge. The door impingement strap (241), of course, requires any one of several known strap terminal fastening means (244). The means (244) may comprise threaded stitching (245), rivets (246), an adhesive (247) or any other acceptable means of joining layers of the strap's (241) fabric.

The invention claimed is:

1. A reciprocation-pull static line exercising assembly comprising a handgrip assembly;

a static line;

a pulley wheel assembly; and pulley wheel assembly tethering means;

the handgrip assembly comprising paired palm bars; and paired stretchable hand wrapping media members, the ends of each connecting in opposition to each end of a respective palm bar;

each palm bar comprising a static line tunnel disposed to pass from the bar's top to its bottom;

media member accommodation means downwardly directed in opposition at each end of a respective palm bar, the accommodation means comprising an opening at the palm bar's top into which the media member is inserted;

a pair of opposing downwardly directed media member access slots, one disposed at each of the palm bars' ends in communication with the respective media member accommodation means; the access opening configured with sufficient width to permit the hand wrapping media member, when thinned out by stretching for the purpose, to be snapped into place within the respective media member accommodation means; and a static line impinger in turn comprising a head;

a stem; and a rotable anchor;

the static line impinger's head disposed at one end of the stem and the rotable anchor at the other end thereof; the rotable anchor configured in a manner such that when retained, remains free to pivot along an axis, causing the stem and head to sweep through a predetermined arc in a plane disposed perpendicular to the pivoting axis;

one end of each hand wrapping media member disposed to ascend from one of the bar's media member accommodation means, extend upward in looped configured permitting it to traverse and embrace the back of an operator's hand and then descend for downward insertion into the bar's other media member accommodation means;

the media member comprising stop means of size sufficient to prevent being pulled out of its respective accommodation means during exercise;

the pulley wheel assembly in turn comprising a pulley wheel;

a pulley wheel axle;

a pulley wheel connecting frame;

the pulley wheel connecting frame secured to one of, a door or wall, by the pulley wheel assembly tethering means;

one end of the static line reeved downwardly through the static line tunnel of one palm bar of a pair; its mid-portion disposed to run therefrom to partially encircle the pulley wheel and then return in extension to the other palm bar of the pair; such that when the palm bars are gripped by the operator, as either end of the static line is drawn backwards, the other is freely advanced; the static line comprising terminal stop means at each end thereof of size sufficient to prevent being pulled out of the tunnel during exercise;

each palm bar of the handgrip assembly further comprising static line impinger axillary retention means wherein the static line impinger's rotable anchor is retained in a manner permitting it to pivot such that the impinger's head is caused to enter the static line tunnel from the underside of the respective palm bar and is disposed in an attitude to impinge against and secure the enreeved static line;

wherein an operator may undertake exercises by gripping each palm bar in a respective hand and alternately withdrawing and advancing the static line in reciprocation-pull fashion.

2. The reciprocation-pull static line exercising assembly according to claim 1 wherein each palm bar's media member accommodation means comprises a tunnel disposed to pass from the palm bar's top to its bottom; each of the palm bar's media member access slots is configured also to extend from the bar's top to its bottom; and the stretchable hand wrapping media member is emplaced by enreevement through the entirety of the tunnel, its stop means reposing at the palm bar's bottom.

3. The reciprocation-pull static line exercising assembly according to claim 1 wherein each palm bar's media member accommodation means comprises a well disposed to pass only part of the distance from the palm bar's top toward its bottom; each of the palm bar's media member access slots is configured also to extend only part of that distance; the stretchable hand wrapping media member is emplaced to extend downwardly into the well; each access slot further comprising an media member's ensconced stop opening configured as an enlargement sufficient to permit the media member and its stop means to be pressed into the well from the palm bar's respective end.

4. The reciprocation-pull static line exercising assembly according to claim 1 wherein each stretchable hand wrapping media member comprises stretchable cord.

5. The reciprocation-pull static line exercising assembly according to claim 1 further comprising a tubularly configured flexible back-of-the-hand restraining pad comprising a longitudinally disposed pad tunnel through which the stretchable hand wrapping media member is enreeved.

6. The reciprocation-pull static line exercising assembly according to claim 1 wherein the pulley wheel assembly tethering means comprises an impingment strap connected to the pulley wheel connecting frame; the impingement strap comprising a thickened sector at an end thereof further comprising strap terminal fastening means.

7. The reciprocation-pull static line exercising assembly according to claim 1 wherein each stretchable hand wrapping media member comprises stretchable sheeting.

8. The reciprocation-pull static line exercising assembly according to claim 4 wherein each stretchable cord comprises hollow configuration and each hand wrapping cord's stop means comprises an embedded stopper.

9. The reciprocation-pull static line exercising assembly according to claim 6 further comprising strap anchoring means.

10. The reciprocation-pull static line exercising assembly according to claim 9 wherein the strap terminal fastening means comprises threaded stitching.

11. The reciprocation-pull static line exercising assembly according to claim 9 wherein the strap terminal fastening means comprises rivets.

12. The reciprocation-pull static line exercising assembly according to claim 9 wherein the pulley wheel assembly tethering means further comprises as the strap anchoring means, an over-the-door bracket for connection with the impingement strap.

13. The reciprocation-pull static line exercising assembly according to claim 9 wherein the pulley wheel tethering assembly means further comprises as the strap anchoring means, a hook attachably mounted to a wall or door for connection with the impingement strap.

14. An exercise palm bar comprising a static line tunnel;

a pair media member accommodation means;

a pair of media member access slots;

a static line impinger;

static line impinger axillary retention means;

each static line tunnel disposed to pass from the bar's top to its bottom;

each media member accommodation means downwardly directed in opposition at each end of the palm bar and comprising an opening at the palm bar's top for a media member's insertion;

one media member access slot disposed at each of the palm bar's ends in communication with the respective media member accommodation means; the access opening configured with sufficient width to permit a hand wrapping media member, when thinned out by stretching for the purpose, to be snapped into place within the respective media member accommodation means;

the static line impinger comprising a head;

a stem; and a rotable anchor;

the static line impinger's head disposed at one end of the stem and the rotable anchor at the other end thereof; the rotable anchor configured in a manner such that when retained, remains free to pivot along an axis, causing the stem and head to sweep through a predetermined arc in a plane disposed perpendicular to the pivoting axis;

the static line impinger axillary retention means comprising retention of the static line impinger's rotable anchor therein a manner permitting it to pivot such that the impinger's head is caused to enter the static line tunnel from the bottom of the respective palm bar and is disposed in an attitude to impinge against and secure a static line enreeved through the tunnel;

wherein, by reason of suitable interconnection with stretchable media members, a static line, a pulley wheel assembly and tethering means therefor, an operator may upon gripping one such bar in each hand, engage in reciprocation-pull exercise.

15. The exercise palm bar according to claim 14 wherein each palm bar's media member accommodation means comprises a tunnel disposed to pass from the palm bar's top to its bottom; each of the palm bar's media member access slots is configured also to extend from the bar's top to its bottom as a full length access slot; such that a stretchable hand wrapping media member may be reeved through the entirety of the tunnel, disposing its stop means at the palm bar's bottom.

16. The exercise palm bar according to claim 14 wherein each palm bar's media member accommodation means comprises a well disposed to pass only part of the distance from the palm bar's top toward its bottom; such that a stretchable hand wrapping media member may be extended downwardly therein; each of the palm bar's media member access slots is configured also to extend only part of the distance from the palm bar's top toward its bottom as a partial length access slot; each access slot further comprising a well's chambered opening configured as an enlargement sufficient to permit the media member and its stop means to be pressed into the well from the palm bar's respective end.

* * * * *